US005824446A

United States Patent [19]

Nishihara et al.

[11] Patent Number: 5,824,446

[45] Date of Patent: Oct. 20, 1998

[54] TONERS FOR DEVELOPING ELECTROSTATICALLY CHARGED IMAGES

[75] Inventors: Yoshikazu Nishihara, Itami; Ichiro Demizu, Toyonaka; Yoshihiro Mikuriya, Amagasaki; Fumiko Nakazawa, Iwata; Hiroshi Fukao, Toyokawa, all of Japan

[73] Assignee: Minolta Co., Ltd., Osaka, Japan

[21] Appl. No.: 837,862

[22] Filed: Apr. 22, 1997

[30] Foreign Application Priority Data

Apr. 23, 1996 [JP] Japan ..... 8-101284
Apr. 23, 1996 [JP] Japan ..... 8-101292

[51] Int. Cl.[6] ..... G06G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,355,088 | 10/1982 | Westdale et al. | 430/98 |
| 4,386,147 | 5/1983 | Seimiya et al. | 430/99 |
| 4,486,524 | 12/1984 | Fujisaki et al. | 430/109 |
| 4,578,338 | 3/1986 | Gruber et al. | 430/99 |
| 4,917,982 | 4/1990 | Tomono et al. | 430/99 |
| 4,939,060 | 7/1990 | Tomiyama et al. | 430/106.6 |
| 4,946,755 | 8/1990 | Inoue | 430/106.6 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,106,715 | 4/1992 | Matsumura et al. | 430/110 |
| 5,124,224 | 6/1992 | Berkes et al. | 430/110 |
| 5,171,653 | 12/1992 | Jugle et al. | 430/108 |
| 5,176,978 | 1/1993 | Kumashiro et al. | 430/110 |
| 5,292,609 | 3/1994 | Yoshikawa et al. | 430/110 |
| 5,424,162 | 6/1995 | Kohri et al. | 430/111 |
| 5,660,964 | 8/1997 | Machida et al. | 430/110 |
| 5,712,071 | 1/1998 | Mikuriya et al. | 430/110 |

*Primary Examiner*—Roland Martin
*Attorney, Agent, or Firm*—McDermott, Will & Emery

[57] ABSTRACT

The present invention relates to toners for developing electrostatically charged images which contains polyethylene fine particles and polypropylene fine particles as wax, which have a specific particle size. By incorporating such polyethylene and polypropylene fine particles into toners the prevention of smear, offset, filming, and improvement of fluidity and chargeability of the toners can be achieved.

20 Claims, 6 Drawing Sheets

TONERS FOR DEVELOPING ELECTROSTATICALLY CHARGED IMAGES

BACKGROUND OF THE INVENTION

1. Field of the Invention

The present invention relates to a toner for developing an electrostatically charged image.

2. Description of the Related Art

Fixing systems currently used in image forming devices of electrophotographic apparatuses include pressure fixing systems, non-contact heat fixing systems such as flash and oven fixing systems, and contact heat fixing systems such as heat roll fixing systems. Among them, contact heat fixing systems are most popular since the contact heat fixing systems can be operated at higher speeds as compared with the pressure fixing systems and show higher heat efficiencies as compared with the non-contact heat fixing systems so that a relatively low temperature heat source can be employed permitting miniaturization of apparatuses and saving of energy.

Recently, still higher speeds and energy saving have been demanded in electrophotographic apparatuses with such contact heat fixing systems; therefore, low temperature fixing properties have been demanded for toners. If low temperature fixing is realized, not only energy saving of electrophotographic apparatuses is promoted but also warm-up periods can be shortened; thus, more comfortable operability can be achieved.

In the above mentioned contact heat fixing systems, there is a problem of offset phenomena. In the heat roll fixing systems, for instance, a portion of toner constituting an image upon fixing is transferred onto the surface of the heat roll and re-transferred to a transfer paper transported subsequently to contaminate another image.

As a technique for preventing the offset phenomenon of the heat roll fixing toners, it has hitherto been known that a polypropylene wax is added to a toner as an offset preventing agent (mold release agent) (see, for example, Japanese Patent Application Laying Open No. 49-65231).

Recently, a copying machine in which an automatic document feeder or a double-side copier is mounted has been standardized as electrophotography becomes higher in copying speeds and multifunctional. However, in these apparatuses, the surface of a copied image is rubbed with a feed roller upon feeding a document or in the back side copying step or in the second copying step of a multicolor copying to cause a bleed or blur in an image (a smear phenomenon). A similar phenomenon is observed when a plurality of copied images are superimposed on each other to temporally store in a copying machine and a sheet by sheet is removed out by a feeding roller for the second copying; in this case image quality is also reduced. A toner having such a problem is said to have poor smear resistance.

The addition of a polyethylene wax into a toner is effective to improve the smear resistance. However, when the polyethylene wax is used together with a polypropylene wax as the aforementioned offset preventing agent, filming tends to occur and the flowability or chargeability of the toner tends to be reduced. Further, the full offset prevention can not be achieved even though the polypropylene wax is added.

SUMMARY OF THE INVENTION

It is an object of the present invention to provide a novel and useful toner for developing electrostatically charged images in which the above mentioned problems are solved.

It is another object of the present invention to provide a toner for developing electrostatically charged images having excellent smear resistance.

It is a further object of the present invention to provide a toner for developing electrostatically charged images which can prevent the occurrence of offset or filming.

Further, it is a still another object of the present invention to provide a toner for developing electrostatically charged images having improved flowability and chargeability.

The present invention relates to a toner for developing electrostatically charged images which contains at least a binder resin, a coloring agent and a wax, wherein said wax comprises a polyethylene and a polypropylene, at least 90% by number of the wax fine particles contained in the toner have a major axis in the range of 0.1 to 10 $\mu$m, at least 60% by number of the wax fine particles having a major axis of 2 $\mu$m or longer have a ratio of the major axis (length) (a) to the minor axis (breadth) (b), i.e., (a/b), of 3/2 or higher, and at least 68% by number of the wax fine particles having a major axis of less than 2 $\mu$m have the ratio a/b of less than 3/2.

Thus, the above noted objects are achieved by the wax used in the present invention in which smaller particles are close to spherical and larger particles are close to oblong.

Also, the present invention relates to a toner for developing electrostatically charged images which contains at least a binder resin, a coloring agent, a polyethylene and a polypropylene, wherein at least 90% by number of the polypropylene fine particles contained in the toner have a major axis in the range of 0.5 to 10 $\mu$m, 2 to 40% by number of the polypropylene fine particles have a major axis of 2 $\mu$m or longer, at least 90% by number of the polyethylene fine particles contained in the toner have a major axis in the range of 0.1 to 2.0 $\mu$m, and at most 2.0% by number of the polyethylene fine particles have a major axis of 2 $\mu$m or longer.

Thus, the above noted objects are achieved by the toner of the present invention in which the particle diameter of the polyethylene in the toner is relatively smaller and the particle diameter of the polypropylene is larger.

These and other objects, advantages and features of the invention will become apparent from the following description thereof taken in conjunction with the accompanying drawings which illustrate specific embodiment of the invention.

BRIEF DESCRIPTION OF THE DRAWINGS

In the following description, like parts are designated by like reference numbers throughout the several drawings, in which.

DESCRIPTION OF THE PREFERRED EMBODIMENTS

Figure 1:
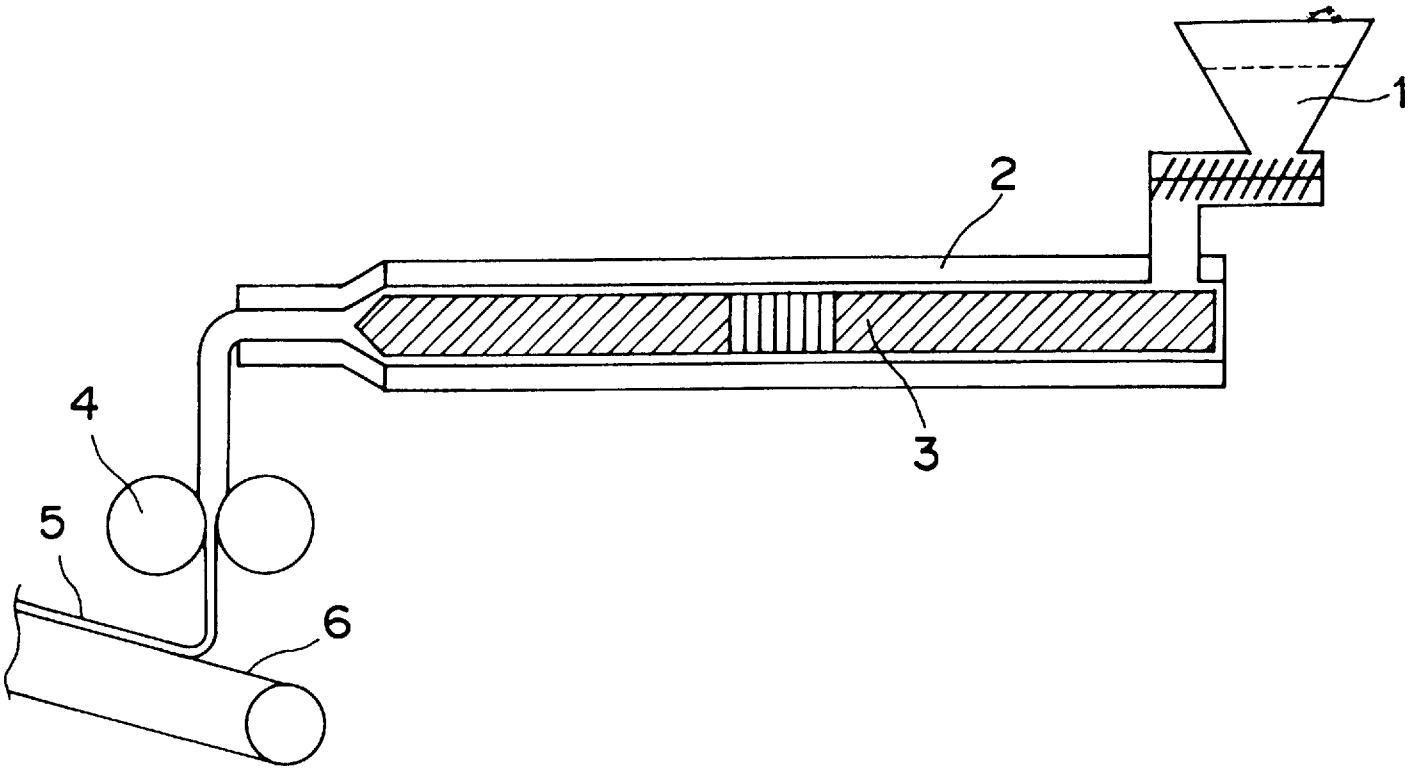
FIG. 1 shows a kneader provided with a press roller.

The present invention relates to a toner for developing electrostatically charged images which comprises at least a binder resin, a coloring agent, and a wax comprising a polyethylene and a polypropylene.

The waxes which can be used are mainly composed of a polyethylene and a polypropylene but other waxes conventionally used in toners, such as carnauba wax, rice wax and sazor wax, may be used so far as the object of the present invention is not impaired.

The polyethylene used has a softening point in the range of 100° to 150° C, preferably 130° to 145° C., and has a softening point lower, preferably 3° to 30° C. lower, than the softening point of a polypropylene used together. If the softening point of the polyethylene is lower than 100° C., the heat resistance will be poor and filming tends to occur. On the contrary, a softening point higher than 150° C. will reduce the smear resistance.

The polyethylene includes both high and low density polyethylenes but high density polyethylenes are especially preferred from the viewpoint of smear resistance.

The polypropylene used has a softening point of 140° to 160° C., preferably 145° to 155° C. If the softening point is lower than 140° C., not only the heat resistance will decrease but also filming may tend to occur. If higher than 160° C., the offset property may be reduced.

In the preferred embodiment of the present invention, the wax is dispersed in a toner in the form of fine particles and at least 90% by number of the fine wax particles have a major axis in the range of 0.1 to 10 μm, more preferably 0.1 to 8 μm. If there are more particles with smaller particle diameters, both offset and smear preventing properties may be reduced. If there are more particles with larger diameters, on the other hand, filming will readily occur.

Preferably, at least 60% by number, more preferably at least 70% by number, of the fine wax particles of 2 μm or higher have a ratio (a/b) of the major axis (a) to the minor axis (b) of 3/2 or more. If the particles having a/b of 3/2 or more is less than 60% by number, the offset property may be deteriorated. In particular, the content of particles having a/b of 2 or more is preferably at least 60% by number. The content of the fine wax particles of less than 2 μm having a/b of 3/2 or less is at least 68% by number, preferably at least 70% by number, more preferably at least 72% by number. If the content is less than 68% by number, filming and fogging may readily occur.

In the fine particles having a major axis of 2 μm or more, the content of fine polypropylene particles is preferably more than that of fine polyethylene particles.

Such a particle diameter distribution of the fine wax particles in a toner, i.e., fine polyethylene and polypropylene particles, can provide a toner in which the smear and offset upon copying are prevented while the problematic filming caused or the decrease of flowability or chargeability of the toner does not occur. It is believed that oblong wax particles of large size contributes to the improvement of offset property while spherical wax particles of small size contributes to the improvement of smear resistance.

In the preferred embodiment of the present invention, the polypropylene and polyethylene are dispersed in a toner in the form of fine particles wherein the particle size of the polyethylene fine particles in the toner is relatively small and the size of polypropylene fine particles is relatively large.

Illustratively, at least 90% by number of the polypropylene fine particles have a major axis in the range of 0.5 to 10 μm, more preferably 0.5 to 8 μm. If they contain more particles having a smaller major axis, the offset property may be reduced. On the other hand, if they contain more particles having a larger major axis, the filming and fogging may readily occur. The content of the polypropylene fine particles having a major axis of 2 μm or larger is 2.0 to 40% by number, preferably 2 to 35% by number, more preferably 3 to 30% by number. With less than 2.0% by number, the offset property will be poor. At 40% by number or more, filming and fogging may readily occur.

At least 90% by number of the polyethylene fine particles in the toner have a major axis in the range of 0.1 to 2.0 μm and the content of polyethylene fine particles of 2 μm or more is at most 2.0% by number, preferably at most 1.0% by number, more preferably at most 0.8% by number. If they contain polyethylene fine particles having a major axis smaller than 0.1μ, the smear resistance will be poor. If they contain too much particles of 2 μm or more, the filming and fogging may readily occur.

Such a particle size distribution of the polyethylene and polypropylene fine particles in a toner can provide a toner in which the smear or offset upon copying is prevented while the occurrence of filming or the reduction of flowability or chargeability of the toner does not occur.

The amount of polyethylene is preferably 0.1 to 2 parts by weight, more preferably 0.3 to 1 part by weight, based on 100 parts by weight of binder resin. Less amounts of polyethylene formulated will be insufficient to prevent the smear. With larger amounts, filming tends to occur and the flowability of toner also tends to decrease.

The amount of polypropylene formulated is 2.5 to 7 parts by weight, preferably 3 to 5 parts by weight, based on 100 parts by weight of binder resin. At smaller amounts of polypropylene formulated, the offset property will be reduced. If the amount is larger, the flowability of toner will be poor and filming may readily occur.

The binder resin used may be any of styrene copolymer, polyester and epoxy resins which have conventionally been used as binder resin for toners; in particular, styrene copolymer resins are preferred as binder resins for effectively achieving the objects of the present invention.

Styrenic monomers constituting the styrene copolymer resins may include styrene, α-methylstyrene, p-methylstyrene, p-tert-butylstyrene and p-chlorostyrene and their derivatives.

Monomers copolymerized with the styrenic monomer(s) may include alkyl esters of methacrylic acid, such as methyl, n-propyl, isopropyl, n-butyl, isobutyl, t-butyl, n-pentyl, isopentyl, neopentyl, 3-(methyl)butyl, hexyl, octyl, nonyl, decyl, undecyl and dodecyl methacrylates; alkyl esters of acrylic acid, such as methyl, n-propyl, isopropyl, n-butyl, isobutyl, t-butyl, n-pentyl, isopentyl, neopentyl, 3-(methyl) butyl, hexyl, octyl, nonyl, decyl, undecyl and dodecyl acrylates; unsaturated carboxylic acids, such as acrylic, methacrylic, itaconic and maleic acids; and vinylic monomers, such as acrylonitrile, maleate esters, itaconate esters, vinyl chloride, vinyl acetate, vinyl benzoate, vinylmethylethyl ketone, vinylhexyl ketone, vinylmethyl ether, vinylethyl ether and vinylisobutyl ether. Preferably, C1–17 alkyl esters of (meth)acrylic acid may be used.

The binder resin may have an acid value to improve the dispersibility of coloring agents. The acid value of the styrene copolymer resin as a binder resin may be controlled by adjusting the amount of an unsaturated carboxylic acid such as (meth)acrylic acid contained in the styrene copolymer resin and is 10.0 KOH mg/g or lower, preferably 3 to 10 KOH mg/g.

The binder resin has a number average molecular weight of 2,000 to 10,000, more preferably 2,500 to 7,000 and a weight average molecular weight/number average molecular weight ratio of 20 to 90, more preferably 25 to 80. If the number average molecular weight is less than 2,000, the heat resistance may be reduced or the offset may readily occur. With a number average molecular weight larger than 10,000, the fixing strength will be reduced. The offset property will decrease at a weight average molecular weight/number average molecular weight ratio smaller than 20 while the fixing strength will be poor at a ratio larger than 90.

The coloring agent used may be any of those which have generally used in conventional toners for electrophotography, such as carbon black, and the amount thereof formulated is not particularly limited.

Other additive(s), such as charge controlling agents, fluidizing agents and cleaning aids (e.g. resin bees etc.), may be optionally formulated.

The charge controlling agents may be any positive or negative charge controlling agents.

The positive charge controlling agent which may be used includes for example nigrosine dyes, triphenylmethane compounds and quaternary ammonium salt compounds. The triphenylmethane compounds which can be used are described in for example Japanese Patent Application Laying Open No. 51-11455, No. 59-100457 and No. 61-124955. Quaternary ammonium salt compounds which can be used may include for example Japanese Patent Application Laying Open No. 4-70849.

Negative charge controlling agents may include salicylic acid metal complexes, gold containing azo dyes, calixarene compounds and boron containing compounds.

When a fluidizing agent is used, fine particles of silica, titanium dioxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate and zinc stearate may be used.

Desirably, these fine particles are subjected to hydrophobic treatment with a silane or titanium coupling agent, a higher fatty acid or a silicone oil prior to use.

The amount of fluidizing agent used is desirably 0.05 to 5 parts by weight, preferably 0.1 to 3 parts by weight, based on 100 parts by weight of toner.

Further, one or more of styrenic, acrylic, methacrylic, benzoguanamine, silicone, teflon, polyethylene and polypropylene organic fine particles granulated by wet polymerization, such as emulsion, soap-free emulsion or non-aqueous dispersion polymerization, or gas phase methods.

The toner can be used in either a one-component developer without using any carrier or two-component developer using a carrier. Preferably, it may be used as a two-component developer. The carrier used together with the toner of the present invention may be any known carrier. For example, carriers comprising magnetic particles such as iron and ferrite particles, coat carriers comprising magnetic particles having a resinous coating agent on the surface thereof, or dispersion carriers comprising magnetic fine particles dispersed in a binder resin. Such a carrier has a volume average particle diameter of 15 to 100 $\mu$m, preferably 20 to 80 $\mu$m.

When the toner is used as a positively charging toner, a preferred carrier has a negatively charging resin on the surface thereof. Such a resin may include a polyester resin, a polyolefin resin such as polyethylene, tetrafluoroethylene, vinylidene fluoride, a homopolymer of fluorine containing vinylic monomer, or a copolymer thereof with other vinylic monomer(s). Particularly preferred is a carrier having the negatively charging resin coating or a carrier comprising magnetic fine particles dispersed in the negatively charging resin, in combination with the toner of the present invention, from the viewpoint of chargeability.

When the toner is used as a negatively charging toner, a preferred carrier has a positively charging resin on the surface. Such a resin includes acrylic, styrene-acrylic and silicone resins.

The toner of the preferred embodiment according to the present invention may be prepared by the following procedures.

First, given materials such as a coloring agent, a binder resin and waxes are mixed in a mixer such as Henschel mixer and kneaded in an extruder (3) equipped with a heat jacket (2) as shown in FIG. 1, for example, a screw extruder, by continuously extruding the mixture (1) under high shear conditions. The kneaded material is pressed between press rollers (4) set at an appropriate distance to form a strip (5) which is then put on a cooling conveyor (6) and led to a crushing step.

In the kneading step, the polyethylene and polypropylene are uniformly dispersed in toner components but they are not soluble in each other and not compatible with the binder resin; thus, many of these exist in the form of discrete fine particles. By suitably adjusting the slit width of the press rollers and/or the viscosity of the kneaded material, these dispersed fine particles are pressed such that larger and smaller diameter particles are made into oblong and relatively spherical shape, respectively; thus, a specific particle size distribution as described above can be obtained. Further, the polyethylene and polypropylene fine particles with such a specific distribution as described above can be provided by suitably adjusting the amount ratio of polyethylene to polypropylene, viscosity, temperature, kneading conditions and press roller distance.

The toner is obtained by crushing the strip followed by classification.

Preferably, the crushing and classifying step is carried out in a crusher or classifier which applies a mechanical impact force onto the particles to be treated. The "mechanical impact force" means a physical impact force produced upon contact of the particles with a rotor which is provided in a crusher and classifier and rotates at a high speed. The use of such a crusher and classifier prevents the generation of ultra fine powder such as free waxes, stabilizes the chargeability of a toner, and improves the filming and flowable properties.

Figure 2:
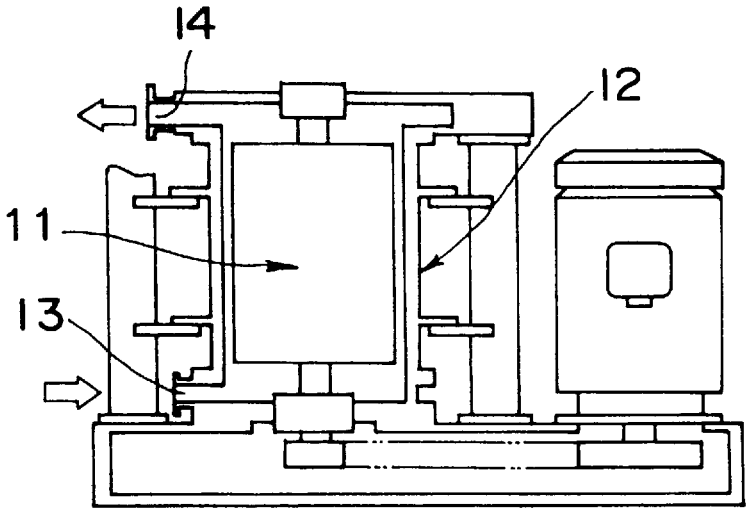
FIG. 2 shows a crusher.

Illustratively, kneaded toner materials in the dry state are subjected to a mechanical crusher. A mechanical crusher capable of applying a mechanical impact force onto particles to be treated comprises a cylindrical vessel (outer cylinder) having grooves on the inside surface thereof and a rotatable cylinder (inner cylinder) which is spaced by a given distance from said inside surface and has grooves on the outside surface thereof. The general structure of such a crusher is schematically shown in FIG. 2.

A rotatable inner cylinder (rotor) (11) has many grooves along the direction of the rotation axis on the outside surface thereof. A cylindrical vessel (outer cylinder) (2) is provided with a liner having many grooves slotted with respect to the direction of the rotation axis on the inside surface thereof. When high speed rotation of the rotor (11) generates vigorous eddy current and pressure vibration, the raw materials are sucked together with air through an inlet (13) and fed into a crushing chamber with the air flow. Subsequently, large diameter particles are volume crushed by an impact force due to the rotor (11) and liner (2) and by a vigorous eddy current of air generated in the gap therebetween. The diameter-reduced particles are surface crushed and ultra fine particles of free waxes are deposited on the surface. The particles are then drawn out through an outlet (14). The "surface crushing" means that the particle surface is worn by peeling action while ultra fine particles are simultaneously deposited on the particle surface; namely rearrangement on the particle surface. This apparatus is preferably used since pulverized wax mainly composed of polyethylene can again be incorporated into a toner to prevent fibrillation.

Figure 3A:
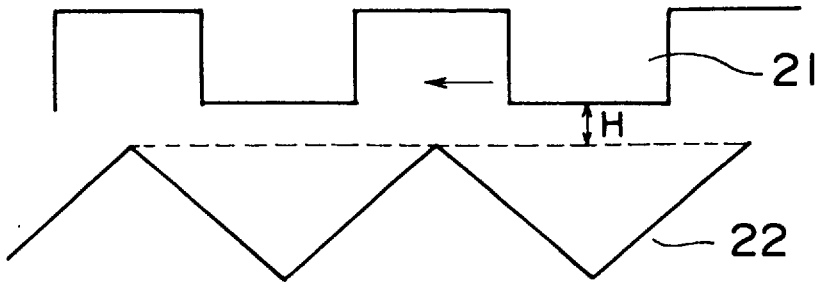
FIG. 3 shows a rotor and a liner.
Figure 3B:
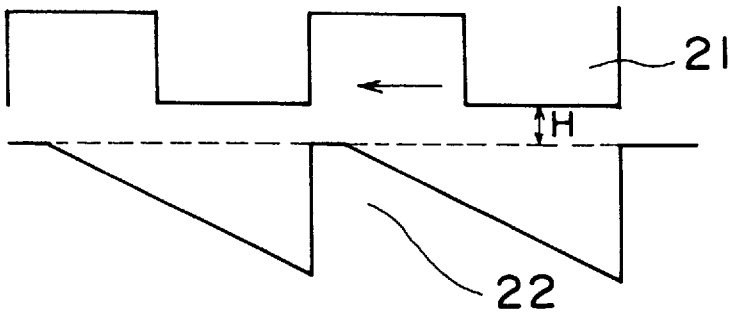
Figure 3C:
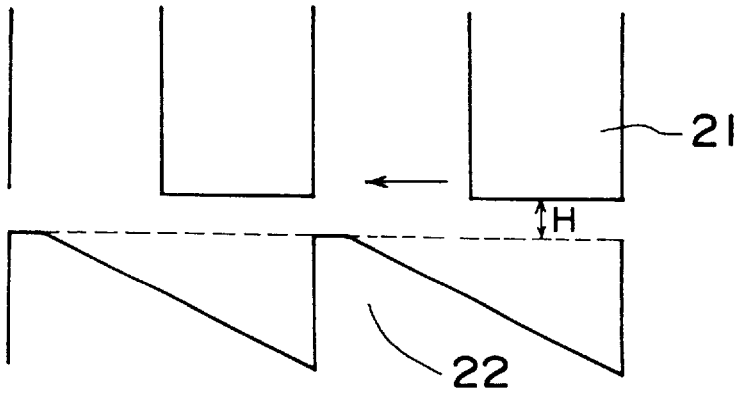

FIG. 3 is a cross section of the rotor (21) and liner (22) taken along the direction perpendicular to the direction of grooves. In FIG. 3, the grooves of the liner have a cross sectional shape of isosceles triangle (FIG. 3A) and are faced to the grooves of the rotor so that the smallest gap therebetween (H) is 0.2 to 10 mm, preferably 0.3 to 5 mm. The cross sectional shape of the liner grooves is not limited to the above and may be a right angled triangle as shown in FIG. 3B). Further, the rotor may be composed of blades (FIG. 3C) instead of grooves. The mechanical crusher as described above, which may be used, includes KRIPTRON manufactured by Kawasaki Heavy Industries, Ltd., TURBOMIL by Turbomil Kogyo, and FINEMIL by Nippon Newmatic Kogyo.

The above described crushing may also be carried out by a multiple pass treatment in a closed circuit.

Preferably, the toner particles crushed by the above described mechanical crusher are classified to remove coarse particles which are then returned to the above described mechanical crusher.

Classifiers which can be used to classify the coarse particles in the crushed particles include coarse powder classifiers such as MS-O from Hosokawa Micron, DS-X classifier from Nippon Newmatic, and Elbowjet from Nittetsu Kogyo.

Finally, the thus obtained crushed fine particles are classified. Preferably, a classifier capable of providing a mechanical impact force is used. The classifier may also be a rotating rotor classifier having a classifying rotor. In the classification, the particle surface is smoothened or rendered more spherical by the action of an impact force by the classifying rotor; ultra fine powder of free waxes is firmly adhered and embedded onto the toner surface by the action of an impact force by the classifying rotor and the free ultra fine powder is reduced; and the classifying effect by the action of an impact force by the classifying rotor improves the dispersion efficiency and contamination of a toner product with the ultra fine powder can be prevented. Such an effect can not be obtained by a conventional air classifier in which particles are sieved by their weight.

Various classifying rotor classifier as mentioned above are known such as Turboclassifier manufactured by Nisshin Engineering, and Acucut, for example, Donaserec classifier by Nihon Donaldson. Among them, Teeplex ultra fine powder classifier ATP series manufactured by Hosokawa Micron is preferred. Among this series, a schematic structure of Teeplex Multiwheel classifier is shown in FIG. 4, which is a central vertical cross section.

Figure 4:
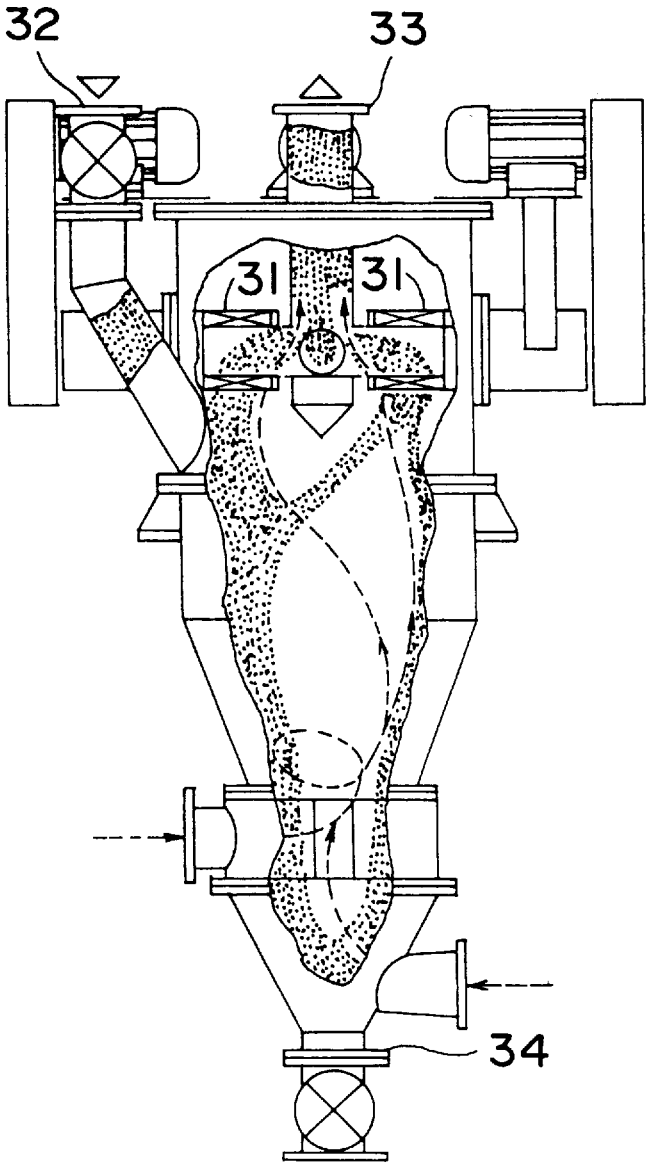
FIG. 4 shows a Teeplex multiwheel classifier.
Figure 5:
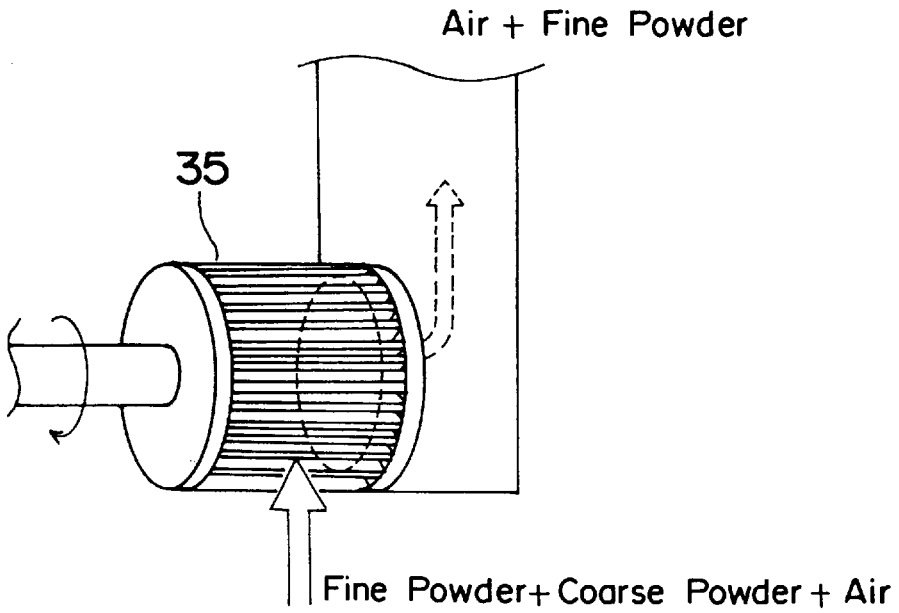
FIG. 5 shows a classifier rotor.

Raw materials (the crushed particles) are charged through a feed inlet (32) and transported through a rotary valve or together with inflow air to a classifying chamber, as shown in FIG. 4. The inflow air runs in the classifier, for example, from the bottom to the top as shown by arrows. The raw materials go up along the air stream and then classified in the classifier (31); fine powder is removed out through a common fine powder exit (33) while the toner particles are removed out through an outlet (34). The classifier (31) is provided with a plurality of individually driven classifying rotors (35) attached horizontally. The classifying rotor (35) is a rotating cylinder having many blades as shown in FIG. 5. Common speed control is performed by a frequency converter.

The thus obtained toner has the wax dispersed with the above described particle size distribution and a shape factor (SF) as defined by the equation below of 130 to 160, preferably 130 to 150. Owing to such a shape factor, the toner has improved flowability and charging stability. Further, filming property is improved due to decrease of free waxes. If the shape factor is less than 130, blade cleaning properties are lowered; the flowability and charging stability are lowered or filming tends to occur with a shape factor of more than 160.

$$SF = \frac{(\text{Maximum length})^2}{\text{Area}} \times \frac{\pi}{4} \times 100$$

wherein the "area" means the projected area of a toner, and the "maximum length" means the maximum length in the projected image of a toner. The shape factor is an average value measured by an image analyzer (Luzex 5000, Nihon Regulator).

Desirably, the toner has a ratio ($D_v/D_p$) of the volume average particle size $D_v$ to the number average particle size $D_p$ in the range of 1.0 to 1.4, preferably 1.0 to 1.35. If $D_v/D_p$ is lager than 1.4, filming or fogging may readily occur since the toner contains an increased amount of fine powder of free waxes.

Now, the present invention will be further illustrated by the following examples.

Preparation of Binder Carrier

To subject a toner to the evaluation as described below, a binder carrier was prepared as follows.

| Ingredient | Part by weight |
|---|---|
| Polyester resin (Kao, NE-111O) | 100 |
| Inorganic magnetic powder (TDK, MFP-2) | 500 |
| Carbon black (Mitsubishi Kasei, MA#8) | 2 |

The above materials were thoroughly mixed and crushed in a Henschel mixer and melt kneaded in an extruder with a cylinder and cylinder head portions set at 180° C. and 170° C., respectively. The kneaded materials were cooled, coarsely crushed, pulverized in a jet mill, and classified in an air classifier to yield a magnetic carrier of 55 $\mu$m in volume average particle size.

Preparation of Coated Carrier

| Preparation of coating resin | |
|---|---|
| Polyoxypropylene (2,2)-2,2-bis(4-hydroxyphenyl)propane | 350 g |
| Polyoxyethylene (2,2)-2,2-bis(4-hydroxyphenyl)propane | 330 g |
| Isophthalic acid | 400 g |
| Dibutyl tin oxide | 2 g |

The above composition was charged into a 3 liter 4-necked glass flask and a thermometer, a stainless stirrer, a condenser and a nitrogen inlet were attached. The composition was reacted while stirring under nitrogen stream in a mantle heater at 200° C. to yield a polyester resin with 15 KOH mg/g.

Preparation of Carrier

Said resin was diluted with toluene to form a polyester resin solution with a solid content of 2% by weight. On calcined ferrite powder (F-300; average particle size of 50

μm; bulk density of 2.53 g/cm; Powdertec) as a core material, said polyester resin solution was applied by a Spira Cota (Okada Seiko) so that the amount of resin applied was about 1% by weight. After drying the obtained carrier was allowed to stand in a hot air circulating oven at 170° C. for 2 hours to calcine. After cooling, the ferrite powder bulk was passed through a sieve shaker to which screen meshes 210 μm and 90 μm had attached to yield a resin coated ferrite powder. This ferrite powder was further subjected to the coating, calcining and crushing more three times to yield a resin coated carrier with a volume average particle size of 53 μm.

Example 1

| | parts by weight |
|---|---|
| Thermoplastic styrene acrylic resin (styrene-butyl acrylate-butyl methacrylate-methcarylic acid copolymer, monomer weight ratio = 7:1.4:1.4:0.2, acid value 6.5 KOH mg/g) | 100 |
| Offset preventing additives | |
| Polypropylene wax (softening point about 145° C., Viscol 660P, Sanyo Kasei) | 4 |
| Polyethylene wax (softening point about 140° C., Hiwax 8000P, Mitsui Petrochemical) | 0.5 |
| Carbon black (Mogul L, Cabot) | 10 |
| Nigrosine dye (Nigrosine base EX, Orient Chemical) | 5.0 |
| Quaternary ammonium salt (P-53, Orient Chemical) | 0.5 |
| Magnetic powder (MFP-2, TDK) | 2 |

The above materials were mixed in a Henschel mixer of 75 liters in volume at 3000 rpm for 3 minutes. The mixture was continuously kneaded in a screw extruder (TEM50, Toshiba Machine Co., Ltd.) as shown in FIG. 1 at a temperature of 120° C., a feed rate of 30 kg/hr and a screw rotation of 150 rpm, rolled between press rollers (4) with a slit distance of 1 mm, and forced water cooled on a belt cooler (6).

The kneaded materials were coarsely crushed in a feather mill (2 mm mesh). The coarse crushed materials were pulverized in a mechanical crusher (Kryptron KTM-O, Kawasaki Heavy Industries, Ltd.) to 11 μm, subjected to a jet mill (IDS-1, Nippon Newmatic) equipped with a natural air stream classifier to remove coarse powder, and further subjected to a rotary rotor classifier (50ATP classifier, Hosokawa Micron) to remove fine powder to yield a toner with a volume average particle size of 11 μm.

To the obtained toner, 0.15% by weight of a hydrophobic silica (R-974, Nippon Aerosil) was added and mixed.

Examples 2 to 6 and Comparative Examples 1 and 2

Toners were prepared as in Example 1. However, the nature of binder resin, the nature and amount of polypropylene wax, the nature and amount of polyethylene wax and the kneading conditions in the preparation process are as shown in Table 1.

Comparative Example 3

The nature of binder resin, the nature and amount of polypropylene wax, the nature and amount of polyethylene wax and the kneading conditions in the preparation process are as shown in Table 1. When the kneaded materials were cooled, the nozzle at the tip (outlet) of the kneader was removed so that no back pressure was applied to the kneaded materials upon discharging, and the materials were not passed through a press roller. The kneaded materials were coarsely crushed in a feather mill. The coarse crushed materials were pulverized in a jet mill (IDS-1, Nippon Newmatic) equipped with a natural air stream classifier, and the obtained pulverized materials were subjected to a natural air stream classifier (DS classifier, Nippon Newmatic) to yield a toner. The obtained toner was treated with a hydrophobic silica as in Example 1.

TABLE 1

| | Binder resin | | | Polypropylene wax | | | Polyethylene wax | | | Kneading conditions | | | |
|---|---|---|---|---|---|---|---|---|---|---|---|---|---|
| | Mn | Mw/Mn | Softening point, Tm | Type | Softening point | Add amount | Type | Softening point | Add amount | Temp. | Feed rate | Secrew revolution | Roller clearance |
| Ex. 1 | 4000 | 68.8 | 121.8 | Viscol 660P | 145° C. | 4 wt parts | Hi-Wax 800P | 140° C. | 0.5 wt parts | 120° C. | 30 kg/hr | 150 rpm | 1 mm |
| Ex. 2 | 4000 | 68.8 | 121.8 | Viscol 660P | 145° C. | 6 wt parts | Hi-Wax 800P | 140° C. | 1.5 wt parts | 120° C. | 40 kg/hr | 200 rpm | 1 mm |
| Ex. 3 | 4000 | 68.8 | 121.8 | Viscol 660P | 145° C. | 3 wt parts | Hi-Wax 800P | 140° C. | 0.2 wt parts | 120° C. | 20 kg/hr | 100 rpm | 3 mm |
| Ex. 4 | 4500 | 83.4 | 127.5 | Viscol 660P | 145° C. | 6 wt parts | Hi-Wax 100P | 121° C. | 1.5 wt parts | 130° C. | 40 kg/hr | 200 rpm | 1 mm |
| Ex. 5 | 2800 | 37.0 | 117.3 | Viscol 330P | 152° C. | 3 wt parts | Hi-Wax 800P | 140° C. | 0.2 wt parts | 110° C. | 20 kg/hr | 100 rpm | 3 mm |
| Ex. 6 | 4000 | 68.8 | 121.8 | Viscol 550P | 150° C. | 4 wt parts | Hi-Wax 400P | 136° C. | 0.5 wt parts | 120° C. | 30 kg/hr | 150 rpm | 1 mm |
| Comp. Ex. 1 | 4500 | 83.4 | 127.5 | Viscol 550P | 150° C. | 7 wt parts | Hi-Wax 400P | 136° C. | 2.5 wt parts | 130° C. | 50 kg/hr | 250 rpm | 1 mm |
| Comp. Ex. 2 | 2800 | 37.0 | 117.3 | Viscol 550P | 150° C. | 2 wt parts | — | — | — | 110° C. | 10 kg/hr | 100 rpm | 5 mm |
| Comp. Ex. 3 | 2800 | 37.0 | 117.3 | Viscol 330P | 152° C. | 3 wt parts | Hi-Wax 800P | 140° C. | 0.2 wt parts | 110° C. | 20 kg/hr | 100 rpm | — |

The properties of the obtained toners and carriers were measured by the following methods. The results are shown in Table 2, wherein "pop %" means % by number of the wax fine particles having a major axis in the range of 0.1 to 10 μm, bracketted values mean % by number of the wax fine particles in the range of 0.1 to 8 μm, "2 μm or more" means the content (% by number) of the wax fine particles having a major axis of 2 μm or more and a ratio (a/b) of major axis (a) to minor axis (b) of 3/2 or more, and "less than 2 μm" means the content (% by number) of the wax fine particles having a major axis less than 2 μm and a ratio a/b less than 3/2.

Shape Factor (SF)

This is defined by the following equation:

$$SF = \frac{(\text{Maximum length})^2}{\text{Area}} \times \frac{\pi}{4} \times 100$$

wherein the "area" means the projected area of a toner, and the "maximum length" means the maximum length in the projected image of a toner, and shows the difference between the major and minor axis (distortion). If completely spherical, SF=100. The shape factor is an average value as measured by an image analyzer (Luzex 5000, Nihon Regulator).

Average Particle Size

A volume average particle size of a carrier was measured by an aperture tube of 280 μm using Coulter multisizer (Coulter). Volume and number average particle sizes of a toner were measured by an aperture tube of 100 μm using the same apparatus.

Charge Amount

Figure 6:
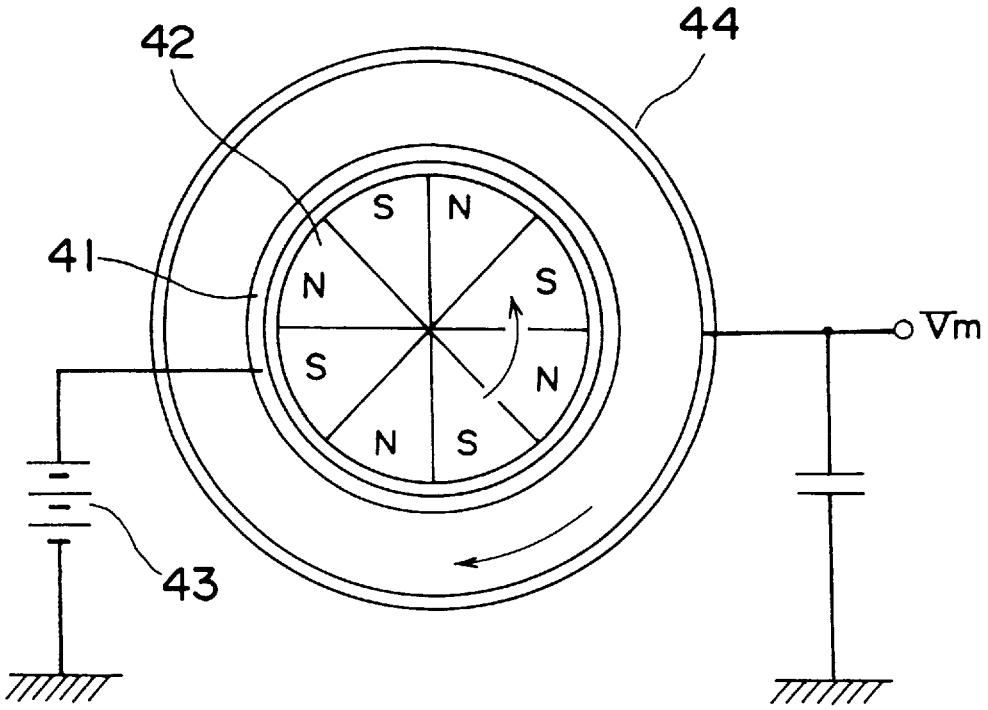
FIG. 6 shows a test charger.

A charge amount [μC/g] was measured as follows. Each carrier was added to a toner so that the weight ratio of toner to carrier was 5/95 (Tc=5% by weight), placed in a polymer bottle of 50 cc, and turned on a rotatory table at 120 rpm for 10 minutes to prepare a developing agent comprising the toner. One g of the developing agent was weighed with a precision balance and placed uniformly on the whole surface of a conductive sleeve (41) of a charging device as shown in FIG. 6 while a magnet roll (42) provided in the conductive slleve (41) was set at a rotating speed of 100 rpm. A bias voltage of 3 KV contrary to the charged potential of the toner was applied from a bias power (43). The conductive sleeve (41) was rotated for 30 seconds. At the time when the conductive sleeve (41) was stopped, the potential Vm at a cylindrical electrode (44) was read while the weight of toner deposited on the cylindrical electrode (4) from the conductive sleeve (1) was measured by a precision balance; thus, an average charge amount [μC/g] of each toner was determined.

Wax Dispersion Particle Size

A toner 0.18 was dissolved in 25 ml of chloroform and the wax was separated in a centrifuge. To the separated wax, 25 ml of chloroform was again added and the wax was separated in a centrifuge. Then, an SEM photograph (×3000) was taken and the particle size of the wax fine particle was calculated.

TABLE 2

| | Toner shape/particle size | | | Wax particle distribution in toner | | |
|---|---|---|---|---|---|---|
| | | Volume mean | | Wax | a/b pop % | |
| | Shape factor | particle size | Dv/Dp | particle size pop % | 2 μm or larger | 2 μm or smaller |
| Ex. 1 | 141 | 11.0 μm | 1.29 | 953% (95.0%) | 74.0% | 76.4% |
| Ex. 2 | 138 | 11.1 μm | 1.29 | 96.7% (96.3%) | 85.5% | 72.9% |
| Ex. 3 | 144 | 10.9 μm | 1.30 | 94.0% (93.8%) | 98.4% | 86.7% | 70.6% |
| Ex. 4 | 135 | 11.1 μm | 1.28 | 93.2% (93.2%) | 65.6% | 83.8% |
| Ex. 5 | 146 | 10.9 μm | 131 | 96.5% (96.2%) | 80.1% | 74.0% |
| Ex. 6 | 140 | 11.0 μm | 131 | 99.1% (98.6%) | 90.4% | 66.2% |
| Comp. Ex. 1 | 132 | 11.3 μm | 1.26 | 87.1% (87.0%) | 51.2% | 92.3% |
| Comp. Ex. 2 | 148 | 10.7 μm | 1.32 | 88.5% (88.4%) | 2.5% | 99.7% |
| Comp. Ex. 3 | 168 | 11.4 μm | 1.43 | | | |

Then, each of the toners and carriers was evaluated in the following way.

Filming 50,000 copies were continuously taken in a copying machine (EP4050, Minolta Co., Ltd.) and a half tone image was made while the photoreceptor was observed. Ranking is as follows.

○: No image turbulence, and no deposition of toner components on photoreceptor.

Δ: No image turbulence, but part of photoreceptor surface being slightly dull.

×: Image turbulence, and whole photoreceptor being dull.

Smear Resistance

A toner was fixed on a copying paper using a copying machine (EP4050, Minolta Co., Ltd.) and another virgin copying paper was rubbed on the side of the copying paper on which the copied image had been formed. The extent of smear on the virgin copying paper was observed and ranked as follows.

○: Almost no smear was noticed.

Δ: Slight smear was observed but there was no problem upon use.

×: Smear was observed on the whole surface of paper.

Fogging

When spilt toner in a copying machine was estimated, toner fogging on the copied image was observed after 50,000 copying. The results were ranked as follows.

○: Almost no fogging was observed.

Δ: Slight fogging was observed but there was no problem upon use.

×: There were much fogging of toner.

Offset Resistance

The fixing roller temperature was raised up to about 250° C. and the temperature at which offset occurred was observed and ranked as follows.

○: No offset at 250° C.

Δ: No offset below 250° C.

×: Offset below 230° C.

TABLE 3

| | Evaluation | | | | | |
|---|---|---|---|---|---|---|
| | Smear | Offset | Filming | Charge | Fogging | Carrier |
| Ex. 1 | ○ | ○ | ○ | 22.7 μC/g | ○ | binder type |
| Ex. 2 | ○ | ○ | ○ | 24.3 μC/g | ○ | binder type |
| Ex. 3 | Δ | ○ | ○ | 20.1 μC/g | ○ | binder type |
| Ex. 4 | ○ | ○ | Δ | 24.8 μC/g | Δ | coat type |
| Ex. 5 | Δ | Δ | ○ | 22.2 μC/g | ○ | coat type |
| Ex. 6 | ○ | ○ | ○ | 23.5 μC/g | ○ | coat type |
| Comp. Ex. 1 | ○ | ○ | x | 26.4 μC/g | x | binder type |
| Comp. Ex. 2 | x | x | ○ | 19.2 μC/g | ○ | binder type |
| Comp. Ex. 3 | ○ | x | x | 18.3 μC/g | x | coat type |

Dispersion Particle Size of Polyethylene and Polypropylene

The wax used to measure the wax dispersion particle size as described above was heated at a temperature above the softening point of polyethylene and below that of polypropylene, cooled and again observed with SEM so that polyethylene and polypropylene were discriminated from each other. The results are shown in Table 4.

TABLE 4

| | Polypropylene wax particle size | | Polyethylene wax particle size | |
|---|---|---|---|---|
| | pop % | 2 μm or larger | pop % | 2 μm or larger |
| Ex. 1 | 94.2% | 17.7% | 93.5% | 0.6% |
| Ex. 2 | 95.5% | 31.6% | 94.9% | 0.9% |
| Ex. 3 | 92.9% | 11.1% | 92.4% | 0.4% |
| Ex. 4 | 96.7% | 37.0% | 96.0% | 1.5% |
| Ex. 5 | 91.4% | 2.6% | 90.2% | 0.2% |
| Ex. 6 | 95.3% | 29.2% | 94.5% | 0.8% |
| Comp. Ex. 1 | 98.5% | 45.1% | 96.7% | 2.9% |
| Comp. Ex. 2 | 85.0% | 1.6% | 0% | 0% |
| Comp. Ex. 3 | 88.2% | 1.8% | 87.5% | 0.1% |

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A toner for developing an electrostatically charged image comprising at least a binder resin, a coloring agent and a wax, wherein said wax comprises a polyethylene and a polypropylene, at least 90% by number of fine wax particles contained in the toner have a major axis in the range of 0.1 to 10 μm, at least 60% by number of the fine wax particles with a major axis of 2 μm or more have a ratio (a/b) of major axis (a) to minor axis (b) of 3/2 or more, and at least 68% by number of the fine wax particles with a major axis of less than 2 μm have the ratio (a/b) less than 3/2.

2. The toner for developing an electrostatically charged image according to claim 1, wherein at least 90% by number of fine wax particles contained in the toner have a major axis in the range of 0.1 to 8 μm, at least 70% by number of the fine wax particles with a major axis of 2 μm or more have a ratio (a/b) of major axis (a) to minor axis (b) of 3/2 or more, and at least 70% by number of the fine wax particles with a major axis of less than 2 μm have the ratio (a/b) less than 3/2.

3. The toner of claim 1, wherein of the fine particles having a major axis of 2 μm or more, the content of fine polypropylene particles is higher than that of fine polyethylene particles.

4. The toner of claim 1, wherein the polypropylene has a softening point of 140° to 160° C. and the polyethylene has a softening point of 100° to 150° C.

5. The toner of claim 1, which comprises 0.1 to 2 parts by weight of polyethylene based on 100 parts by weight of binder resin.

6. The toner of claim 1, which comprises 2.5 to 7 parts by weight of polypropylene based on 100 parts by weight of binder resin.

7. The toner of claim 1, wherein the binder resin is a styrenic polymer resin.

8. The toner of claim 7, wherein the styrenic polymer resin is composed of a styrenic monomer selected from the group consisting of styrene, α-methylstyrene, α-methylstyrene, p-tert-butylstyrene and p-chlorostyrene, and a derivative thereof.

9. The toner of claim 7, wherein the binder resin has a number average molecular weight of 2000 to 10000 and a weight average molecular weight/number average molecular weight ratio of 20 to 90.

10. The toner of claim 7, wherein the binder resin has an acid value of 3 to 10 KOH mg/g.

11. The toner of claim 1, wherein the toner particles have a shape factor of 130 to 160 and a ratio ($D_v/D_p$) of a volume average particle size ($D_v$) to number average particle size ($D_p$) of the toner of 1.0 to 1.4.

12. A toner for developing an electrostatically charged image comprising at least a binder resin, a colored resin and a wax, wherein said wax comprises a polyethylene and a polypropylene, at least 90% by number of fine polypropylene particles contained in the toner have a major axis in the range of 0.5 to 10 μm, 2 to 40% by number of the fine polypropylene particles have a major axis of 2 μm or more, at least 90% by number of fine polyethylene particles contained in the toner have a major axis in the range of 0.1 to 2.0 μm, and at most 2.0% by number of the fine polyethylene particles have a major axis of 2 μm or more.

13. The toner of claim 12, wherein at least 90% by number of fine polypropylene particles contained in the toner have a major axis in the range of 0.5 to 8 μm, 2 to 35% by number of the fine polypropylene particles have a major axis of 2 μm or more, at least 90% by number of the fine polyethylene particles contained in the toner have a major axis in the range of 0.1 to 2.0 μm, and at most 1.0% by number of the fine polyethylene particles have a major axis of 2 μm or more.

14. The toner of claim 12, wherein the polypropylene has a softening point of 140° to 160° C., the polyethylene has a softening point of 100° to 150° C., and the softening point of the polypropylene is higher than that of the polyethylene.

15. The toner of claim 12, which comprises 0.1 to 2 parts by weight of polyethylene based on 100 parts by weight of binder resin.

16. The toner of claim 12, which comprises 2.5 to 7 parts by weight of polypropylene based on 100 parts by weight of binder resin.

17. The toner of claim 12, wherein the binder resin is a styrenic polymer resin.

18. The toner of claim 17, wherein the styrenic polymer resin is composed of a styrenic monomer selected from the group consisting of styrene, α-methylstyrene, p-methylstyrene, p-tert-butylstyrene and p-chlorostyrene, and a derivative thereof.

19. The toner of claim 17, wherein the binder resin has a number average molecular weight of 2000 to 10000 and a weight average molecular weight/number average molecular weight ratio of 20 to 90.

20. The toner of claim 12, wherein the toner particles have a shape factor of 130 to 160 and a ratio ($D_v/D_p$) of a volume average particle size ($D_v$) to number average particle size ($D_p$) of the toner of 1.0 to 1.4.

* * * * *